US005212852A

United States Patent [19]

Zachres

[11] Patent Number: 5,212,852

[45] Date of Patent: May 25, 1993

[54] SAFETY FASTENER

[76] Inventor: Georg Zachres, Heuchelheimerstr. 20, D-6380 Bad Homburg, Fed. Rep. of Germany

[21] Appl. No.: 869,727

[22] Filed: Apr. 16, 1992

[30] Foreign Application Priority Data

Apr. 16, 1991 [DE] Fed. Rep. of Germany ..... 4112319

[51] Int. Cl.[5] ..... A44B 19/00

[52] U.S. Cl. ..... 24/418; 24/421; 70/68

[58] Field of Search ..... 24/418, 415, 387, 421, 24/422, 436; 70/68, 57

[56] References Cited

U.S. PATENT DOCUMENTS

| | | | |
|---|---|---|---|
| 2,071,544 | 2/1937 | Kroll | 24/418 |
| 2,166,581 | 7/1939 | Carlile | 70/68 |
| 2,188,620 | 1/1940 | Boenecke | 70/68 |
| 2,277,831 | 3/1942 | Poux | 24/418 |
| 2,303,750 | 12/1942 | Marinsky | 24/418 |
| 3,320,645 | 5/1967 | Burbank | 24/421 |
| 3,837,050 | 9/1974 | Takamatsu | 24/421 |
| 4,271,689 | 6/1981 | Kasai | 24/418 |
| 4,438,550 | 3/1984 | Oda | 24/418 |

FOREIGN PATENT DOCUMENTS

| | | | |
|---|---|---|---|
| 0556972 | 10/1943 | United Kingdom | 24/418 |
| 0851767 | 10/1960 | United Kingdom | 24/421 |

*Primary Examiner*—Victor N. Sakran

*Attorney, Agent, or Firm*—Robert W. Becker & Associates

[57] ABSTRACT

A safety fastener that includes a slide for selectively opening and closing teeth of the fastener. Provided in one leg of the slide is a pin that is mounted in the leg in such a way that it is displaceable at right angles to the slide. A spindle is provided for shifting the pin between two end positions, namely a first end position where the pin extends into the teeth of the fastener, and a second end position where the pin releases the teeth.

3 Claims, 1 Drawing Sheet

Fig. 7
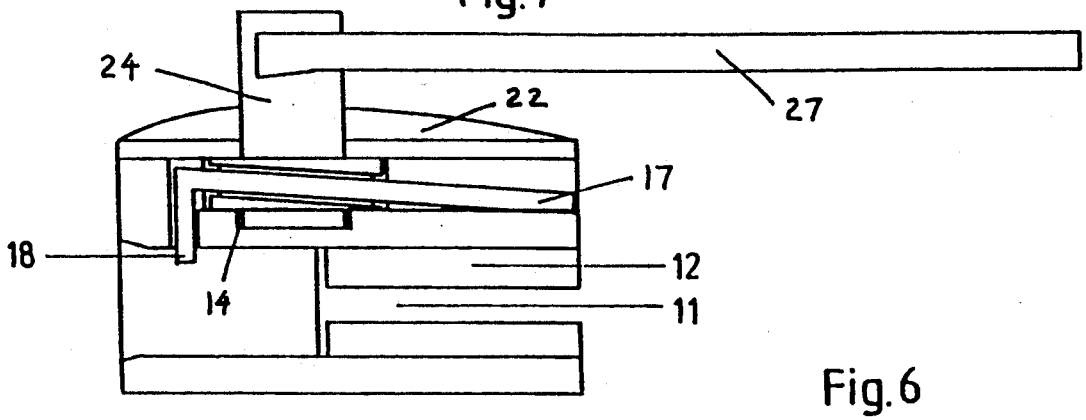
Fig. 6
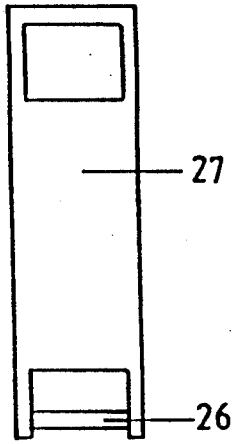
Fig. 2
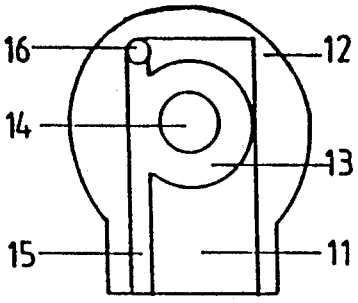
Fig. 1
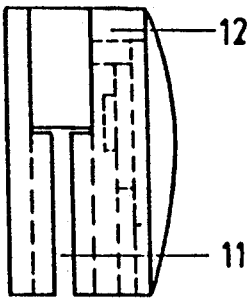
Fig. 5
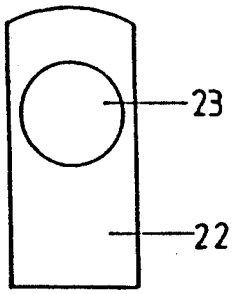
Fig. 8
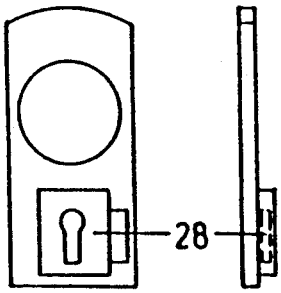
Fig. 9
Fig. 4
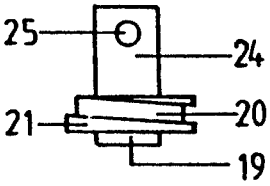
Fig. 3
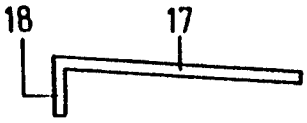

SAFETY FASTENER

BACKGROUND OF THE INVENTION

The present invention relates to a safety fastener that includes a slide for selectively opening and closing teeth of the fastener, with the teeth being disposed on a textile band and being made of metal, plastic, or some other material.

Fasteners of this type have the annoying and unfortunate characteristic that they always open on their own when such opening is not desired, as a consequence of which the slide shifts by itself. For this reason, the procedure has already been adopted to provide a pin or similar means on the actuating handle that is disposed on the slide; by pivoting the handle, the pin is introduced between two teeth so that the slide can no longer shift by itself on the securing means and thereby open the same. However, this known arrangement has the drawback that the actuating handle that carries the securing pin can be secured only very loosely on the slide, so that even slight vibrations permit the pin to withdraw from the teeth of the fastener, as a consequence of which the fastener is no longer protected from opening on its own.

It is therefore an object of the present invention to provide a fastener slide that can no longer open on its own, so that a fastener that is equipped with such a slide no longer opens on its own, but rather always remains securely closed unless it has first been opened.

BRIEF DESCRIPTION OF THE DRAWING

This object, and other objects and advantages of the present invention, will appear more clearly from the following specification in conjunction with the accompanying drawing, in which:

FIGS. 1–6 show components of one exemplary embodiment of the inventive safety fastener;

FIG. 7 is a partially cross-sectioned view of the slide of the inventive fastener; and FIGS. 8 and 9 show a cover that is provided with lock means.

SUMMARY OF THE INVENTION

The safety fastener of the present invention is characterized primarily in that one of the leg means for the slide is provided with a pin or similar means that is mounted in the leg means in such a way that it is displaceable at right angles to the slide; also provided is a spindle for shifting the pin means between two end positions, namely a first end position where the pin means extends into the teeth of the fastener, and a second end position where the pin means releases the teeth.

Further specific features of the present invention will be described in detail subsequently.

DESCRIPTION OF PREFERRED EMBODIMENTS

Referring now to the drawing in detail, FIG. 2 is a plan view of the safety fastener slide 11 shown in FIG. 1. Provided in the upper side piece or leg 12 of the slide 11 is a circular recess 13, the diameter of which corresponds to the spindle of FIG. 4. Disposed in the middle of this recess 13 is a further recess 14, the diameter of which corresponds to the shaft stub or end 19 of the spindle of FIG. 4. Disposed tangential to the recess 13 is a groove or slot 15 that ends in a bore 16, which is disposed perpendicular to the plane of the slide 11.

Disposed in the groove 15 is a wire 17 (see also FIG. 3), the end of which carries a bent-away portion 18 that forms a pin that in turn is disposed in the bore 16. As shown in FIG. 4, the underside of the spindle is provided with a shaft stub or end 19 that fits into the recess 14 of the slide 11. The spindle has a threaded portion 21 that is provided with a steeply inclined thread 20 The threaded portion 21 itself fits into the recess 13 of the slide 11, with the long part of the wire 17 being disposed in the thread 20 of the spindle of FIG. 4. Finally, after the spindle of FIG. 4 is placed into the recesses provided in the upper leg 12 of the slide 11, a cover 22 is placed thereon, with this cover being provided with an opening or aperture 23 that allows the shaft 24 of the spindle to pass through. The cover 22 is secured on the slide 11 in a known manner. The spindle shaft 24 is provided with a transverse bore 25 in which the shaft 26 of the handle 27 is disposed, and via which the spindle can be turned. The pitch of the thread 20 is such that if the spindle is turned by 180°, the pin 18 will be disposed in one of two end positions, whereby in one end position the pin 18 extends into the teeth of the fastener or into the end lug at the end of the row of teeth, and thus prevents a shifting of the slide 11. In the other end position, the pin 18 is withdrawn from the bore 16 to such an extent that the pin 18 is disposed beyond the fastener teeth, so that the slide 11 can be shifted freely in order to open or close the fastener.

Instead of using the upper leg 12 as a housing as described in conjunction with the drawing, it is also possible to use the lower leg as a housing, in which case a bore must be provided on the slide for accommodating the spindle shaft 24. This spindle shaft must then be made appropriately longer so that the handle 27 can be properly mounted.

It can be readily seen from the drawing that the spindle of FIG. 4 can be easily turned with the handle 27. However, it is also possible to provide a small lock means 28 on the underside (inner surface) of the cover 22 or on the slide 11 so that the fastener can be actuated only after the lock means has been unlocked.

The advantage of the inventive fastener slide is that the securing means of the slide cannot open or be released on its own, and that this is made possible with very straightforward means.

It is to be understood that the spindle of FIG. 4 or the wire/pin 17 can also have a different form as long as this form ensures that by rotating the spindle, the pin 18 can either be lowered into its bore 16 between the fastener teeth or can be withdrawn out of this securing position. Furthermore, instead of the thread 20, the spindle can also have a different form; for example, the spindle can be in the form of a cam via which the pin 18 can be raised by means of the wire 17. Lowering of the pin 18 is then effected via the spring effect of the wire 17, the end of which is fixed or restrained.

The present invention is, of course, in no way restricted to the specific disclosure of the specification and drawing, but also encompasses any modifications within the scope of the appended claims.

What I claim is:

1. A safety fastener that includes a slide for selectively opening and closing teeth of said fastener, said fastener further comprising:

leg means for said slide, with a pin means being mounted in said leg means such that it is displaceable at right angles to said slide;

a spindle for shifting said pin means between two end positions, namely a first end position where said pin means extends into said teeth of said fastener, and a second end position where said pin means releases said teeth;

a wire that is connected to said pin means and extends approximately parallel to said slide; and in which said spindle is provided with a thread on an outer periphery thereof, with said wire being disposed in said thread, and said spindle is further provided with an actuating handle; and said pin means has a length that is coordinated with the pitch of said thread of said spindle such that a 180° rotation of said spindle moves said pin means from one of said end positions to the other of said end positions thereof.

2. A safety fastener according to claim 1, in which said leg means of said slide includes two legs; and which includes a cover for securing said spindle and said pin means in one of said legs.

3. A safety fastener according to claim 1, in which said slide is provided with lock means having means for holding said pin means in a securing position.

* * * * *